US012441942B2

(12) United States Patent
Goyheneix et al.

(10) Patent No.: US 12,441,942 B2
(45) Date of Patent: Oct. 14, 2025

(54) TREATING AND STEAM CRACKING A COMBINATION OF PLASTIC-DERIVED OIL AND USED LUBRICATING OILS TO PRODUCE HIGH-VALUE CHEMICALS

(71) Applicant: SABIC Global Technologies B.V., Bergen op Zoom (NL)

(72) Inventors: Nicolas Goyheneix, Riemst (BE); Lara Galan-Sanchez, Eindhoven (NL)

(73) Assignee: SABIC Global Technologies B.V., Bergen op Zoom (NL)

( * ) Notice: Subject to any disclaimer, the term of this patent is extended or adjusted under 35 U.S.C. 154(b) by 0 days.

(21) Appl. No.: 17/593,976

(22) PCT Filed: May 6, 2020

(86) PCT No.: PCT/IB2020/054293
§ 371 (c)(1),
(2) Date: Sep. 29, 2021

(87) PCT Pub. No.: WO2020/234679
PCT Pub. Date: Nov. 26, 2020

(65) Prior Publication Data

US 2022/0177785 A1 Jun. 9, 2022

Related U.S. Application Data

(60) Provisional application No. 62/851,520, filed on May 22, 2019.

(51) Int. Cl.
*C10G 69/06* (2006.01)
*C10G 7/06* (2006.01)
(Continued)

(52) U.S. Cl.
CPC ..... *C10G 9/36* (2013.01); *C10G 7/06* (2013.01); *C10G 21/20* (2013.01); *C10G 21/22* (2013.01);
(Continued)

(58) Field of Classification Search
CPC ... C10G 9/36; C10G 9/06; C10G 7/06; C10G 21/20; C10G 21/22; C10G 21/06;
(Continued)

(56) References Cited

U.S. PATENT DOCUMENTS 3,639,229 A * 2/1972 Brownawell ..... C10M 175/005 208/184
4,244,808 A * 1/1981 Lang ..... C10G 69/06 208/143
(Continued)

FOREIGN PATENT DOCUMENTS

CN 109642164 A 4/2019
DE 4311034 A1 10/1994
(Continued)

OTHER PUBLICATIONS

Buckland, et al. "The Re-refining of Used Lubricating Oils." VII-Energy-B-Refining Used Oils, 6 pages, Obtained from https://nzic.org.nz/app/uploads/2017/10/7B.pdf on Feb. 5, 2019.
(Continued)

*Primary Examiner* — Michelle Stein
(74) *Attorney, Agent, or Firm* — Norton Rose Fulbright US LLP

(57) ABSTRACT

Systems and methods for producing one or more olefins using waste plastics and used lubricating oil are disclosed. Mixed waste plastic is processed in a pyrolysis unit to produce plastic derived oil. The plastic derived oil is subsequently blended with used lubricating oil to form a mixture. The mixture is then separated into (1) a light-end
(Continued)

stream comprising C1 to C8 hydrocarbons and (2) a heavy hydrocarbon feed stream. The heavy hydrocarbon feed stream is then processed to produce a steam cracking feedstock stream. The light end-stream and/or the steam cracking feedstock stream are then flowed into a cracking unit to produce one or more olefins.

15 Claims, 2 Drawing Sheets

(51) Int. Cl.
*C10G 9/36* (2006.01)
*C10G 21/20* (2006.01)
*C10G 21/22* (2006.01)
*C10G 55/04* (2006.01)

(52) U.S. Cl.
CPC ..... *C10G 55/04* (2013.01); *C10G 69/06* (2013.01); *C10G 2300/1007* (2013.01); *C10G 2300/1062* (2013.01); *C10G 2400/20* (2013.01); *C10G 2400/30* (2013.01)

(58) Field of Classification Search
CPC ..... C10G 55/04; C10G 2300/1007; C10G 2300/1062; C10G 2400/20; C10G 2400/30; C10G 33/00; C10G 65/14; C10G 67/04; C10G 1/002; C10G 1/10
See application file for complete search history.

(56) References Cited

U.S. PATENT DOCUMENTS 5,731,483 A * 3/1998 Stabel ..... B29B 17/02 208/130
5,849,964 A 12/1998 Holighaus et al.
5,904,838 A * 5/1999 Kalnes ..... C10G 65/04 208/143
6,150,577 A * 11/2000 Miller ..... C10G 1/10 585/734
6,165,349 A * 12/2000 Madar ..... C10B 49/16 208/55
7,638,040 B2 * 12/2009 Van Wees ..... C10G 7/003 208/143
2002/0036158 A1 * 3/2002 Austin ..... B01D 3/10 196/124
2003/0199718 A1 * 10/2003 Miller ..... C10G 1/002 208/18
2009/0223862 A1 * 9/2009 MacDonald ..... C10G 45/04 208/184
2012/0228113 A1 * 9/2012 Rolston ..... B29B 17/04 202/117
2013/0180888 A1 * 7/2013 Corscadden ..... C10G 55/04 208/309
2016/0264885 A1 * 9/2016 Narayanaswamy ... C10G 45/02
2018/0002609 A1 * 1/2018 Narayanaswamy ..... C10G 1/02
2018/0037829 A1 * 2/2018 Calla ..... C10G 67/0436
2018/0155638 A1 * 6/2018 Al-Ghamdi ..... C10G 7/06
2018/0245001 A1 * 8/2018 Humphreys ..... C10G 31/10

FOREIGN PATENT DOCUMENTS

JP 2002212571 A 7/2002
WO WO2016142808 A1 9/2016
WO WO2018055555 A1 3/2018
WO WO2018069794 A1 4/2018
WO WO2018104443 A1 6/2018
WO WO2018127813 A1 7/2018

OTHER PUBLICATIONS

International Search Report and Written Opinion from PCT/IB2020/054293 mailed Jul. 10, 2020, 12 pages.

* cited by examiner

TREATING AND STEAM CRACKING A COMBINATION OF PLASTIC-DERIVED OIL AND USED LUBRICATING OILS TO PRODUCE HIGH-VALUE CHEMICALS

CROSS REFERENCE TO RELATED APPLICATIONS

This application is a national phase application under 35 U.S.C. § 371 of International Application No. PCT/IB2020/054293 filed May 6, 2020, which claims priority to U.S. Provisional Patent Application No. 62/851,520 filed May 22, 2019. The entire contents of each of the above-referenced disclosures is specifically incorporated by reference herein without disclaimer.

FIELD OF INVENTION

The present invention generally relates to systems and methods for producing high-value chemicals. More specifically, the present invention relates to systems and methods for producing high-value chemicals from plastic-derived oil and/or used lubricating oil.

BACKGROUND OF THE INVENTION

High value chemicals, including light olefins ($C_2$ to $C_4$ olefins) and BTX (benzene, toluene, and xylene), are generally produced from crude oil fractions. Light olefins ($C_2$ to $C_4$ olefins) are building blocks for many chemical processes. Light olefins are used to produce polyethylene, polypropylene, ethylene oxide, ethylene chloride, propylene oxide, and acrylic acid, which, in turn, are used in a wide variety of industries such as the plastic processing, construction, textile, and automotive industries. Generally, light olefins are produced by steam cracking naphtha and dehydrogenating paraffin.

BTX is a group of aromatics that is used in many different areas of the chemical industry, especially the plastic and polymer sectors. For instance, benzene is a precursor for producing polystyrene, phenolic resins, polycarbonate, and nylon. Toluene is used for producing polyurethane and as a gasoline component. Xylene is feedstock for producing polyester fibers and phthalic anhydride. In the petrochemical industry, benzene, toluene, and xylene are conventionally produced by catalytic reforming of naphtha.

Over the last few decades, the demand for both light olefins and BTX has been consistently increasing. Shortage of the feedstocks for producing light olefins and BTX has become a long-term concern. A few alternative feedstocks (e.g., propane) are currently used to produce light olefins. However, propane is used to produce propylene via catalytic dehydrogenation, which requires both high capital and operational expenditure. Furthermore, catalytic dehydrogenation generally requires high purity feedstocks of paraffins for producing only the corresponding olefins, which could further increase the production cost.

U.S. Pat. No. 5,904,838, which discloses a process for the simultaneous conversion of waste lubricating oil and pyrolysis oil derived from organic waste to produce a synthetic crude oil by means of contacting the combined feed with a hot hydrogen-rich gaseous stream to increase the temperature of the combined feed to vaporize at least a portion of the distillable organic compounds contained therein which is immediately hydrogenated in a hydrogenation reaction zone. The resulting effluent from the hydrogenation reaction zone is then introduced into a hydroprocessing zone to produce higher hydrogen-content hydrocarbons and to remove heterogeneous components such as sulfur, oxygen, nitrogen and halide, for example. The resulting effluent is cooled and partially condensed to produce a gaseous stream containing hydrogen and gaseous water-soluble inorganic compounds and a liquid stream containing hydrocarbon compounds. The gaseous stream is scrubbed to remove the gaseous water-soluble organic compounds and to thereby produce a hydrogen-rich gaseous recycle stream. This reference describes production of a synthetic crude and does not teach or suggest production of light olefins and/or BTX.

Overall, while the methods of producing high-value petrochemicals exist, the need for improvements in this field persists in light of at least the aforementioned drawbacks for the conventional methods.

BRIEF SUMMARY OF THE INVENTION

A solution to at least some of the above mentioned problems associated with methods of producing one or more olefins has been discovered. The solution resides in a method of producing light olefins using plastic derived oil and used lubricating oil as the feedstocks. Because the discovered method provides an alternative feedstock for producing light olefins and/or BTX, it addresses the long-term concerns regarding feedstock shortage. Furthermore, the feedstocks used in the discovered method are low cost and/or recycled material, thereby reducing the impact on the environment and minimizing the cost for feedstocks compared to conventional methods. Additionally, the method can be conducted in a system that can be integrated within the existing light olefins and/or BTX production systems, thereby reducing the capital expenditure compared to conventional methods that include catalytic dehydrogenation of paraffins. Therefore, the method of the present invention provides a technical solution to at least some of the problems associated with the conventional methods for producing light olefins and/or BTX.

Embodiments of the invention include a method of producing one or more olefins. The method comprises blending a plastic derived oil with a used lubricating oil to form a blended hydrocarbon feed. The method comprises separating the blended hydrocarbon feed to form (1) a light-end stream comprising primarily $C_1$ to $C_8$ hydrocarbons and (2) a heavy hydrocarbon feed. The method also comprises flowing the light-end stream to a steam cracking unit. The method further comprises processing the heavy hydrocarbon feed to produce a steam cracking feedstock. The method further still comprises cracking (1) hydrocarbons of the steam cracking feedstock and (2) hydrocarbons of the light-end stream to produce one or more olefins.

Embodiments of the invention include a method of producing one or more olefins. The method comprises pyrolizing plastic material to form a plastic derived oil. The method further comprises separating the blended hydrocarbon feed to form (1) a light-end stream comprising primarily $C_1$ to $C_8$ hydrocarbons and (2) a heavy hydrocarbon feed. The method comprises flowing the light-end stream to a steam cracking unit. The method further comprises processing the heavy hydrocarbon feed to produce a steam cracking feedstock. The method further still comprises cracking (1) hydrocarbons of the steam cracking feedstock and (2) hydrocarbons of the light-end stream to produce one or more olefins.

Embodiments of the invention include a method of producing one or more olefins. The method comprises pyrolizing, in a pyrolysis unit, plastic material at a temperature in a range of 100 to 500° C. and a pressure in a range of 0.05 to 10 barg to form a plastic derived oil. The method further comprises separating the blended hydrocarbon feed to form (1) a light-end stream comprising primarily $C_1$ to $C_8$ hydrocarbons and (2) a heavy hydrocarbon feed. The method comprises flowing the light-end stream to a steam cracking unit. The method further comprises processing the heavy hydrocarbon feed to produce a steam cracking feedstock. The processing of the heavy hydrocarbon feed comprises distilling the heavy hydrocarbon feed via vacuum distillation to produce a vacuum distillation residue and a vacuum distilled hydrocarbon stream. The processing of the heavy hydrocarbon feed comprises processing the vacuum distilled hydrocarbon stream via liquid-liquid extraction to produce a poly-aromatics stream comprising primarily poly-aromatics and an intermediate stream. The processing of the heavy hydrocarbon feed comprises hydroprocessing the intermediate stream to produce the steam cracking feedstock. The method further comprises recycling the poly-aromatics stream and/or the vacuum residue to the pyrolysis unit. The method further still comprises cracking (1) hydrocarbons of the steam cracking feedstock and (2) hydrocarbons of the light-end stream to produce one or more olefins.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The term "lubricating oil," as that term is used in the specification and/or claims, means a class of oils used to reduce the friction, heat, and wear between mechanical components that are in contact with each other. The term "used lubricating oil," as that term is used in the specification and/or claims, means lubricating oil that has partially or completely lost its capability of reducing the friction, heat, and wear between mechanical components after a period of usage; and/or lubricating oil that has accumulated contaminants after a period of usage.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol %. For example, "primarily" may include 50.1 wt. % to 100 wt. % and all values and ranges there between, 50.1 mol. % to 100 mol. % and all values and ranges there between, or 50.1 vol % to 100 vol % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

Currently, high-value petro-chemicals including one or more olefins and/or BTX are produced via steam cracking and/or catalytically cracking of naphtha or other fractions of petroleum. However, as the demands for these chemicals consistently increase, feedstock shortage has become a long term concern. Another method used for producing light olefins is catalytic dehydrogenation of paraffins. However, the catalytic dehydrogenation process requires a separate production system, thereby increasing the capital expenditure for producing light olefins. Furthermore, the catalytic dehydrogenation process requires the feedstock to be a single alkane, resulting in high costs for feedstocks. The present invention provides a solution to at least some of these problems. The solution is premised on a method of producing one or more olefins using plastic derived oil and/or used lubricating oil as feedstocks. This method is capable of providing an alternative source of feedstocks to the feedstocks for the conventional methods, thereby addressing the concerns about insufficient feedstocks. Notably, the feedstocks for the discovered method are derived from waste or recyclable sources, resulting in a more environmentally friendly process compared to the conventional methods. Moreover, this method can be implemented in the existing system for steam cracking and/or catalytic cracking, resulting in reduced capital expenditure compared to catalytic dehydrogenation of paraffins. These and other non-limiting aspects of the present invention are discussed in further detail in the following sections.

A. System for Producing One or More Olefins

Figure 1:
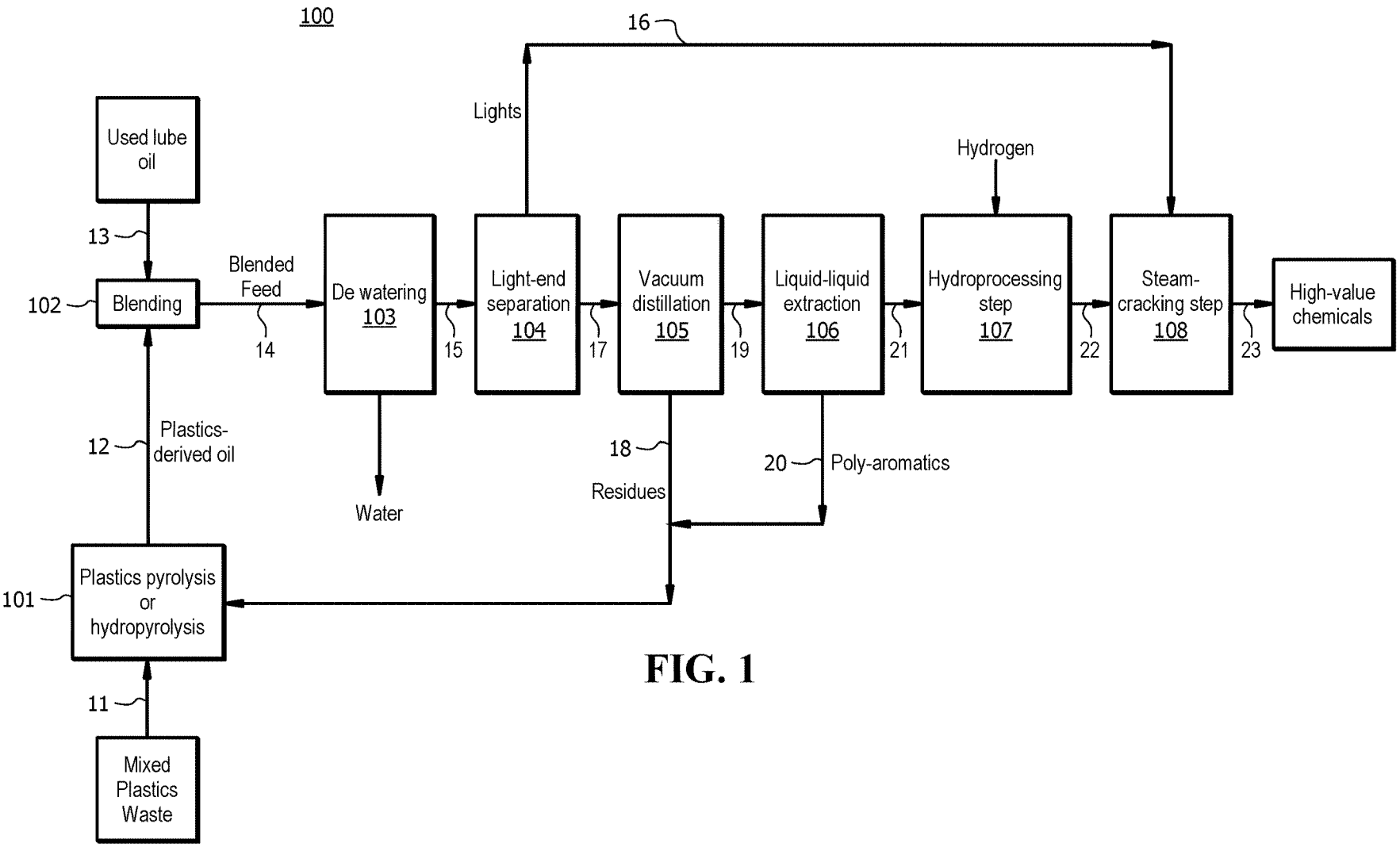
FIG. 1 shows a schematic diagram of a system for producing one or more olefins, according to embodiments of the invention.

In embodiments of the invention, the system for producing one or more olefins can include a pyrolysis unit, a separation unit, a distillation unit, an extraction unit, a hydroprocessing unit, and a steam cracking unit. With reference to FIG. 1, a schematic diagram is shown of system 100 for producing one or more olefins. According to embodiments of the invention, system 100 includes pyrolysis unit 101.

In embodiments of the invention, pyrolysis unit 101 is configured to convert plastic under pyrolysis conditions and produce plastic derived oil stream 12 comprising primarily plastic derived oil. In embodiments of the invention, pyrolysis unit 101 can include a plastic pyrolysis unit and/or a hydropyrolysis unit. According to embodiments of the invention, the plastic can include mixed plastic waste stream 11 flowed into pyrolysis unit 101. In embodiments of the invention, plastic derived oil stream 12 comprises hydrocarbons having an initial boiling point of 0 to 200° C. and a final boiling point of 300 to 750° C.

According to embodiments of the invention, an outlet of pyrolysis unit 101 is in fluid communication with an inlet of blender 102 such that plastic derived oil stream 12 flows from pyrolysis unit to blender 102. In embodiments of the invention, blender 102 is configured to blend plastic derived oil of plastic derived oil stream 12 and used lubricating oil of lubricating oil stream 13 to form blended feed hydrocarbon stream 14.

In embodiments of the invention, an outlet of blender 102 is in fluid communication with de-watering unit 103 such that blended hydrocarbon feed stream 14 flows from blender 102 to de-watering unit 103. According to embodiments of the invention, de-watering unit 103 is configured to remove at least some water from blended feed stream 14 to produce dewatered blended feed stream 15. In embodiments of the invention, non-limiting examples of de-watering unit 103 includes one or more coalescers, one or more decanters, one or more resin based water absorption units, one or more pervaporation units, one or more membrane based dewatering units, and combinations thereof.

According to embodiments of the invention, an outlet of de-watering unit 103 is in fluid communication with an inlet of separation unit 104 such that dewatered blended feed stream 15 flows from de-watering unit 103 to separation unit 104. In embodiments of the invention, separation unit 104 is configured to separate dewatered blended feed stream 15 to produce light-end stream 16 and heavy hydrocarbon feed stream 17. In embodiments of the invention, light-end stream 16 comprises primarily $C_1$ to $C_8$ hydrocarbons. Heavy hydrocarbon feed stream 17 comprises primarily $C_8$ to $C_{30}$ hydrocarbons. In embodiments of the invention, separation unit 104 includes one or more distillation columns, one or more flash drums, or combinations thereof.

According to embodiments of the invention, a first outlet of separation unit 104 is in fluid communication with an inlet of vacuum distillation unit 105 such that heavy hydrocarbon feed stream 17 flows from separation unit 104 to vacuum distillation unit 105. In embodiments of the invention, vacuum distillation unit 105 is configured to distill heavy hydrocarbon feed stream 17 to form vacuum distillation residue stream 18 and vacuum distilled hydrocarbon stream 19. In embodiments of the invention, vacuum distillation residue stream 18 comprises hydrocarbons having an initial boiling point of 400 to 550° C. and a final boiling point of 600 to 750° C. Vacuum distilled hydrocarbon stream 19 may comprise hydrocarbons having an initial boiling point of 150 to 300° C. and a final boiling point of 400 to 550° C.

According to embodiments of the invention, a first outlet of vacuum distillation unit 105 is in fluid communication with pyrolysis unit 101 such that vacuum distillation residue stream 18 flows from vacuum distillation unit 105 to pyrolysis unit 101. Pyrolysis unit 101 may be further configured to convert vacuum distillation residue stream 18 under pyrolysis conditions to produce some plastic-derived oil. According to embodiments of the invention, a second outlet of vacuum distillation unit 105 is in fluid communication with extraction unit 106 such that vacuum distilled hydrocarbon stream 19 flows from vacuum distillation unit 105 to extraction unit 106. In embodiments of the invention, extraction unit 106 is configured to extract poly-aromatics from vacuum distilled hydrocarbon stream 19 to produce poly-aromatics stream 20 and intermediate stream 21. In embodiments of the invention, poly-aromatics stream 20 comprises primarily poly-aromatics. Intermediate stream 21 comprises primarily paraffinic naphthenic, and branched aromatic hydrocarbons. In embodiments of the invention, extraction unit 106 includes a liquid-liquid extraction unit. Extraction unit 106 may comprise one or more extraction drums, one or more extraction columns, one or more extractive distillation columns, one or more contact vessels, or combinations thereof. In embodiments of the invention, solvent used in extraction unit 106 includes morpholines, pyrollidones, cyclic sulfone, or combinations thereof.

In embodiments of the invention, a first outlet of extraction unit 106 may be in fluid communication with pyrolysis unit 101 such that poly-aromatics stream 20 flows from extraction unit 106 to pyrolysis unit 101. Pyrolysis unit 101 may be further configured to convert poly-aromatics stream 20 under pyrolysis conditions to produce plastic-derived oil. According to embodiments of the invention, a second outlet of extraction unit 106 is in fluid communication with hydroprocessing unit 107 such that intermediate stream 21 flows from extraction unit 106 to hydroprocessing unit 107. In embodiments of the invention, hydroprocessing unit 107 is configured to saturate hydrocarbon molecules, remove hetero-atoms such as, but not limited to, sulfur, oxygen, nitrogen, and chlorine, and/or crack the feed hydrocarbon stream into a product hydrocarbon stream with a lower boiling range via hydroprocessing to produce steam cracking feedstock stream 22. In embodiments of the invention, hydroprocessing unit 107 includes one or more fixed bed reactors and/or one or more fluidized bed reactors. Hydroprocessing unit 107 may include a catalyst comprising cobalt, nickel, molybdenum, zeolite, acidic catalyst, or combinations thereof.

According to embodiments of the invention, an outlet of hydroprocessing unit 107 is in fluid communication with an inlet of steam cracking unit 108 such that steam cracking feedstock stream 22 flows from hydroprocessing unit 107 to steam cracking unit 108. According to embodiments of the invention, a second outlet of separation unit 104 is in fluid communication with an inlet of steam cracking unit 108 such that light-end stream 16 flows from separation unit 104 to steam cracking unit 108. In embodiments of the invention, steam cracking unit 108 is configured to steam-crack hydrocarbons of steam cracking feedstock stream 22 and/or light-end stream 16 to produce product stream 23. Product stream 23 comprises one or more olefins, preferably light olefins. Product stream 23 may further comprise BTX (benzene, toluene, xylene).

B. Method of Producing High-Value Chemicals

Figure 2:
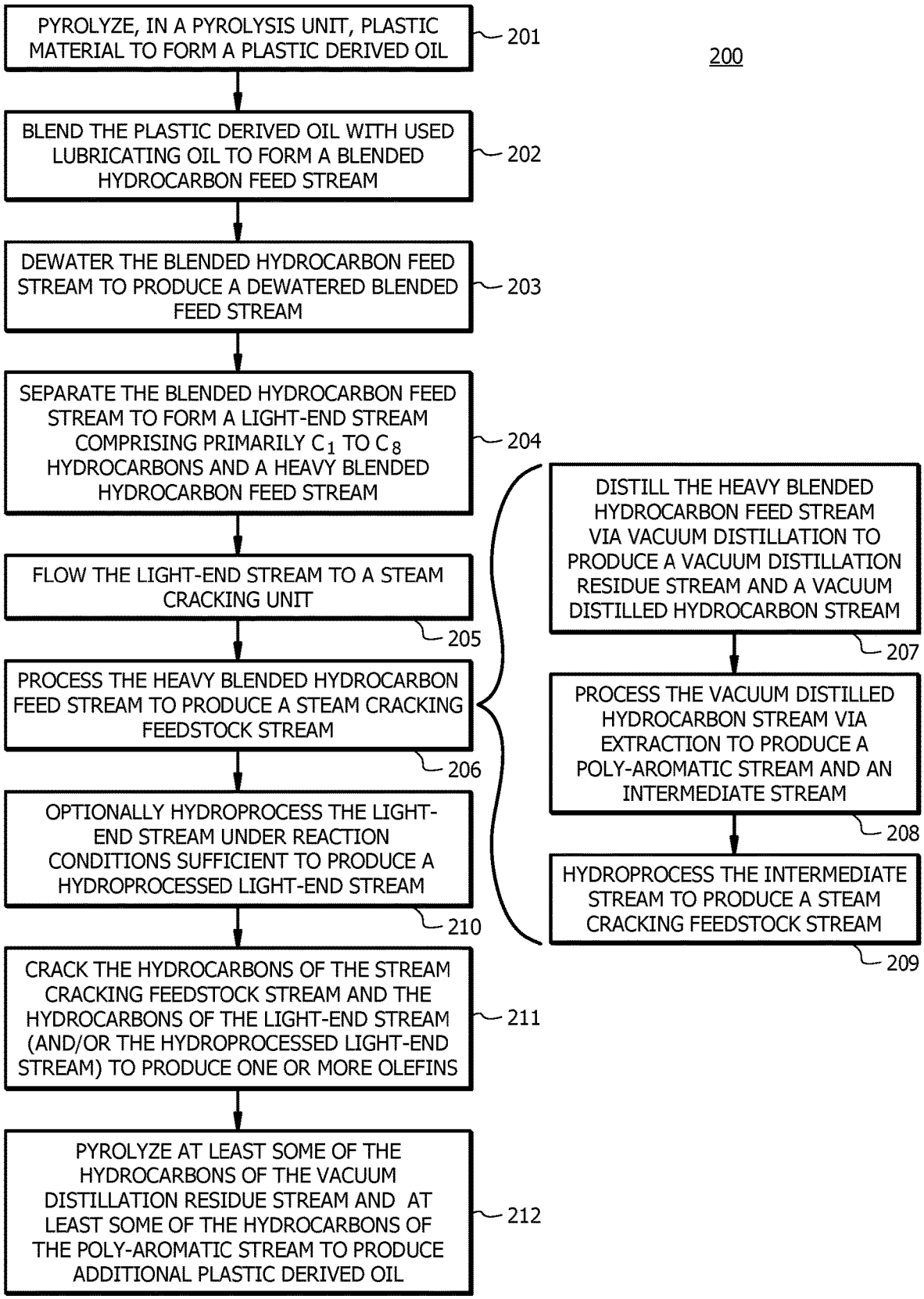
FIG. 2 shows a schematic flowchart for a method of producing one or more olefins, according to embodiments of the invention.

Methods of producing high-value chemicals, including one or more olefins, have been discovered. Embodiments of the method are capable of relieving the concerns about shortage of feedstocks for light olefins production. Furthermore, embodiments of the method are capable of reducing capital expenditure and production costs for light olefins and/or BTX production compared to catalytic dehydrogenation of paraffins. As shown in FIG. 2, embodiments of the invention include method 200 for producing one or more light olefins. Method 200 may be implemented by system 100, as shown in FIG. 1.

According to embodiments of the invention, as shown in block 201, method 200 includes pyrolyzing, in pyrolysis unit 101, plastic material of mixed plastic waste stream 11 to form plastic derived oil of plastic derived oil stream 12. In embodiments of the invention, pyrolyzing at block 201 is performed at a temperature in a range of 100 to 500° C. and all ranges and values there between including ranges of 100 to 120° C., 120 to 140° C., 140 to 160° C., 160 to 180° C., 180 to 200° C., 200 to 220° C., 220 to 240° C., 240 to 260° C., 260 to 280° C., 280 to 300° C., 300 to 320° C., 320 to 340° C., 340 to 360° C., 360 to 380° C., 380 to 400° C., 400 to 420° C., 420 to 440° C., 440 to 460° C., 460 to 480° C., and 480 to 500° C. In embodiments of the invention, pyrolyzing at block 201 is performed at a pressure in a range of 0.05 to 10 barg and all ranges and values there between including ranges of 0.05 to 0.1 barg, 0.1 to 0.2 barg, 0.2 to 0.3 bar, 0.3 to 0.4 barg, 0.4 to 0.5 barg, 0.5 to 0.6 barg, 0.6 to 0.7 barg, 0.7 to 0.8 barg, 0.8 to 0.9 barg, 0.9 to 1 barg, 1 to 2 barg, 2 to 3 barg, 3 to 4 barg, 4 to 5 barg, 5 to 6 barg, 6 to 7 barg, 7 to 8 barg, 8 to 9 barg, and 9 to 10 barg. In embodiments of the invention, the plastic derived oil includes paraffinic, naphthenic, and aromatic hydrocarbons, or combinations thereof.

According to embodiments of the invention, as shown in block 202, method 200 includes blending, in blender 102, plastic derived oil of plastic derived oil stream 12 with used lubricating oil of lubricating oil stream 13 to form blended hydrocarbon feed stream 14. In embodiments of the invention, blending is performed at a temperature in a range of 20 to 400° C. and all ranges and values there between including ranges of 20 to 40° C., 40 to 60° C., 60 to 80° C., 80 to 100° C., 100 to 120° C., 120 to 140° C., 140 to 160° C., 160 to 180° C., 180 to 200° C., 200 to 220° C., 220 to 240° C., 240 to 260° C., 260 to 280° C., 280 to 300° C., 300 to 320° C., 320 to 340° C., 340 to 360° C., 360 to 380° C., and 380 to 400° C.

In embodiments of the invention, as shown in block 203, method 200 may include dewatering blended hydrocarbon feed stream 14 to produce dewatered blended feed stream 15. In embodiments of the invention, dewatered blended feed stream 15 includes less than 1 wt. % water.

According to embodiments of the invention, as shown in block 204, method 200 includes separating, in separation unit 104, blended hydrocarbon feed stream 14 (and/or dewatered blended feed stream 15) to form (1) light-end stream 16 comprising primarily $C_1$ to $C_8$ hydrocarbons and (2) heavy hydrocarbon feed stream 17. In embodiments of the invention, heavy hydrocarbon feed stream 17 comprises primarily $C_8$ to $C_{30}$ hydrocarbons. In embodiments of the invention, separation unit 104 can include a distillation column and the distillation column is operated at an overhead temperature range of 150 to 250° C. and a reboiler range of 200 to 350° C. The distillation column of separation unit 104 may be operated at an operating pressure of 1 to 30 bar and all ranges and values there between including ranges of 1 to 3 bar, 3 to 6 bar, 6 to 9 bar, 9 to 12 bar, 12 to 15 bar, 15 to 18 bar, 18 to 21 bar, 21 to 24 bar, 24 to 27 bar, and 27 to 30 bar. According to embodiments of the invention, as shown in block 205, method 200 includes flowing light-end stream 16 to steam cracking unit 108.

According to embodiments of the invention, as shown in block 206, method 200 includes processing heavy hydrocarbon feed stream 17 to produce steam cracking feedstock stream 22. In embodiments of the invention, steam cracking feedstock stream 22 includes primarily paraffinic and naphthenic hydrocarbons. In embodiments of the invention, as shown in block 207, processing at block 206 comprises distilling heavy hydrocarbon feed stream 17 via vacuum distillation to produce vacuum distillation residue stream 18 and vacuum distilled hydrocarbon stream 19. In embodiments of the invention, the vacuum distillation at block 207 is performed at an overhead temperature of 200 to 300° C. and a reboiler range of 350 to 400° C. A feed temperature for vacuum distillation at block 207 is in a range of 50 to 400° C. and all ranges and values there between including ranges of 50 to 60° C., 60 to 80° C., 80 to 100° C., 100 to 120° C., 120 to 140° C., 140 to 160° C., 160 to 180° C., 180 to 200° C., 200 to 220° C., 220 to 240° C., 240 to 260° C., 260 to 280° C., 280 to 300° C., 300 to 320° C., 320 to 340° C., 340 to 360° C., 360 to 380° C., and 380 to 400° C. The vacuum distillation at block 207 may be performed at an operating pressure of 1 to 900 mbar (abs). In embodiments of the invention, vacuum distillation residue stream 18 comprises primarily hydrocarbons with a boiling point higher than 500° C.

In embodiments of the invention, as shown in block 208, processing at block 206 comprises processing vacuum distilled hydrocarbon stream 19 via extraction to produce poly-aromatic stream 20 comprising primarily poly-aromatics and intermediate stream 21. In embodiments of the invention, the extraction at block 208 includes liquid-liquid extraction. The extraction at block 208 is performed at a temperature in a range of 20 to 150° C. and all ranges and values there between including ranges of 20 to 30° C., 30 to 40° C., 40 to 50° C., 50 to 60° C., 60 to 70° C., 70 to 80° C., 80 to 90° C., 90 to 100° C., 100 to 110° C., 110 to 120° C., 120 to 130° C., 130 to 140° C., and 140 to 150° C. In embodiments of the invention, intermediate stream 21 comprises less than 30 wt. % poly-aromatics.

In embodiments of the invention, as shown in block 209, processing at block 206 comprises hydroprocessing intermediate stream 21 to produce steam cracking feedstock stream 22. In embodiments of the invention, hydroprocessing at block 209 is performed in presence of a catalyst comprising cobalt, nickel, molybdenum, zeolite, acidic catalyst, or combinations thereof. In embodiments of the invention, hydroprocessing at block 209 is performed at an operating pressure of 30 to 200 barg and all ranges and values there between including ranges of 30 to 40 barg, 40 to 50 barg, 50 to 60 barg, 60 to 70 barg, 70 to 80 barg, 80 to 90 barg, 90 to 100 barg, 100 to 110 barg, 110 to 120 barg, 120 to 130 barg, 130 to 140 barg, 140 to 150 barg, 150 to 160 barg, 160 to 170 barg, 170 to 180 barg, 180 to 190 barg, and 190 to 200 barg. In embodiments of the invention, hydroprocessing at block 209 is performed at a temperature in a range of 200 to 450° C. and all ranges and values there between including ranges of 200 to 210° C., 210 to 220° C., 220 to 230° C., 230 to 240° C., 240 to 250° C., 250 to 260° C., 260 to 270° C., 270 to 280° C., 280 to 290° C., 290 to 300° C., 300 to 310° C., 310 to 320° C., 320 to 330° C., 330 to 340° C., 340 to 350° C., 350 to 360° C., 360 to 370° C., 370 to 380° C., 380 to 390° C., 390 to 400° C., 400 to 410° C., 410 to 420° C., 420 to 430° C., 430 to 440° C., and 440 to 450° C. In embodiments of the invention, hydroprocessing at block 209 is performed at a weight hourly space velocity in a range of 0.05 to 10 $hr^{-1}$ and all ranges and values there between including ranges of 0.05 to 0.10 $hr^{-1}$, 0.10 to 0.20 $hr^{-1}$, 0.20 to 0.30 $hr^{-1}$, 0.30 to 0.40 $hr^{-1}$, 0.40 to 0.50 $hr^{-1}$, 0.50 to 0.60 $hr^{-1}$, 0.60 to 0.70 $hr^{-1}$, 0.70 to 0.80 $hr^{-1}$, 0.80 to 0.90 $hr^{-1}$, 0.90 to 1.0 $hr^{-1}$, 1.0 to 2.0 $hr^{-1}$, 2.0 to 3.0 $hr^{-1}$, 3.0 to 4.0 $hr^{-1}$, 4.0 to 5.0 $hr^{-1}$, 5.0 to 6.0 $hr^{-11}$, 6.0 to 7.0 $hr^{-1}$, 7.0 to 8.0 $hr^{-1}$, 8.0 to 9.0 $hr^{-1}$, and 9.0 to 10 $hr^{-1}$. In embodiments of the invention, hydroprocessing at block 209 is configured to saturate unsaturated hydrocarbon molecules, remove hetero-atoms such as, but not limited to, sulfur, oxygen, nitrogen, and chlorine, and/or crack the feed hydrocarbon stream into a product hydrocarbon stream with a lower boiling range.

According to embodiments of the invention, as shown in block 210, method 200 may include hydroprocessing light-end stream 16 under reaction conditions sufficient to produce a hydroprocessed light-end stream (not shown in FIG. 1). In embodiments of the invention, hydroprocessing of light-end stream 16 at block 210 is performed in the presence of a catalyst comprising cobalt, nickel, molybdenum, or combinations thereof. Hydroprocessing conditions at block 210 may be less severe than hydroprocessing conditions for hydroprocessing intermediate stream 21 at block 209. In embodiments of the invention, hydroprocessing conditions at block 210 include a temperature in a range of 250 to 400° C. and all ranges and values there between including ranges of 250 to 260° C., 260 to 270° C., 270 to 280° C., 280 to 290° C., 290 to 300° C., 300 to 310° C., 310 to 320° C., 320 to 330° C., 330 to 340° C., 340 to 350° C., 350 to 360° C., 360 to 370° C., 370 to 380° C., 380 to 390° C., and 390 to 400° C. Hydroprocessing conditions at block 210 may include a pressure in a range of 30 to 100 bar and all ranges and values there between including ranges of 30 to 40 bar, 40 to 50 bar, 50 to 60 bar, 60 to 70 bar, 70 to 80 bar, 80 to 90 bar, and 90 to 100 bar. In embodiments of the invention, hydroprocessing conditions at block 210 include a weight hourly space velocity in a range of 0.05 to 10 $hr^{-1}$ and all ranges and values there between including ranges of 0.05 to 0.10 $hr^{-1}$, 0.10 to 0.20 $hr^{-1}$, 0.20 to 0.30 $hr^{-1}$, 0.30 to 0.40 $hr^{-1}$, 0.40 to 0.50 $hr^{-1}$, 0.50 to 0.60 $hr^{-1}$, 0.60 to 0.70 $hr^{-1}$, 0.70 to 0.80 $hr^{-1}$, 0.80 to 0.90 $hr^{-1}$, 0.90 to 1.0 $hr^{-1}$, 1.0 to 2.0 $hr^{-1}$, 2.0 to 3.0 $hr^{-1}$, 3.0 to 4.0 $hr^{-1}$, 4.0 to 5.0 $hr^{-1}$, 5.0 to 6.0 $hr^{-1}$, 6.0 to 7.0 $hr^{-1}$, 7.0 to 8.0 $hr^{-1}$, 8.0 to 9.0 $hr^{-1}$, and 9.0 to 10 $hr^{-1}$.

According to embodiments of the invention, as shown in block 211, method 200 includes cracking (1) hydrocarbons of steam cracking feedstock stream 22 and/or (2) hydrocarbons of light-end stream (and/or the hydroprocessed light-end stream) to produce one or more olefins. In embodiments of the invention, cracking at block 211 is performed in a steam cracking unit. The cracking at block 211 may be performed at a temperature in a range of 750 to 950° C. and all ranges and values there between including ranges of 750 to 760° C., 760 to 770° C., 770 to 780° C., 780 to 790° C., 790 to 800° C., 800 to 810° C., 810 to 820° C., 820 to 830° C., 830 to 840° C., 840 to 850° C., 850 to 860° C., 860 to 870° C., 870 to 880° C., 880 to 890° C., 890 to 900° C., 900 to 910° C., 910 to 920° C., 920 to 930° C., 930 to 940° C., and 940 to 950° C. Cracking at block 211 may be performed with a residence time of steam-cracking furnace in a range of 10 to 1000 ms and all ranges and values there between including ranges of 10 to 20 ms, 20 to 30 ms, 30 to 40 ms, 40 to 50 ms, 50 to 60 ms, 60 to 70 ms, 70 to 80 ms, 80 to 90 ms, 90 to 100 ms, 100 to 200 ms, 200 to 300 ms, 300 to 400 ms, 400 to 500 ms, 500 to 600 ms, 600 to 700 ms, 700 to 800 ms, 800 to 900 ms, and 900 to 1000 ms. In embodiments of the invention, cracking at block 211 is performed with a hydrocarbon feed to steam volumetric ratio in a range of 0.1 to 1.5 and all ranges and values there between including ranges of 0.1 to 0.2, 0.2 to 0.3, 0.3 to 0.4, 0.4 to 0.5, 0.5 to 0.6, 0.6 to 0.7, 0.7 to 0.8, 0.8 to 0.9, 0.9 to 1.0, 1.0 to 1.1, 1.1 to 1.2, 1.2 to 1.3, 1.3 to 1.4, and 1.4 to 1.5. In embodiments of the invention, the one or more olefins produced at block 211 includes one or more of ethylene, propylene, butenes, butadiene, or combinations thereof. In embodiments of the invention, cracking at block 211 further produces BTX (benzene, toluene, xylene). According to embodiments of the invention, as shown in block 212, method 200 may include pyrolyzing, in pyrolysis unit 101, at least some hydrocarbons of (i) vacuum distillation residue stream 18 and/or (ii) hydrocarbons of poly-aromatic stream 20 to produce additional plastic derived oil. In embodiments of the invention, a portion of (i) vacuum distillation residue stream 18 and/or (ii) hydrocarbons of poly-aromatic stream 20 may go to disposal.

Although embodiments of the present invention have been described with reference to blocks of FIG. 2, it should be appreciated that operation of the present invention is not limited to the particular blocks and/or the particular order of the blocks illustrated in FIG. 2. Accordingly, embodiments of the invention may provide functionality as described herein using various blocks in a sequence different than that of FIG. 2.

In the context of the present invention, at least the following 18 embodiments are described. Embodiment 1 is a method of producing one or more olefins. The method includes blending a plastic derived oil with a used lubricating oil to from a blended hydrocarbon feed. The method further includes separating the blended hydrocarbon feed to form (1) a light-end stream containing primarily $C_1$ to $C_8$ hydrocarbons and (2) a heavy hydrocarbon feed. The method also includes flowing the light-end stream to a steam cracking unit. In addition, the method includes processing the heavy hydrocarbon feed to produce a steam cracking feedstock, and cracking (1) hydrocarbons of the steam cracking feedstock and (2) hydrocarbons of the light-end stream to produce one or more olefins. Embodiment 2 is the method of embodiment 1, further including, prior to the blending step, pyrolizing, in a pyrolysis unit, plastic material to form the plastic derived oil. Embodiment 3 is the method of embodiment 2, wherein the pyrolizing is carried out at a temperature in a range of 100 to 500° C. Embodiment 4 is the method of either of embodiments 2 or 3, wherein the pyrolizing is carried out at a pressure in a range of 0.05 barg to 10 barg. Embodiment 5 is the method of any of embodiments 1 to 4, further including, prior to flowing the light-end stream to the steam cracking unit, and hydroprocessing the light-end stream. Embodiment 6 is the method of embodiment 5, wherein the hydroprocessing of the light-end stream is performed at a temperature in a range of 250 to 400° C. Embodiment 7 is the method of either of embodiments 5 or 6, wherein the hydroprocessing of the light-end stream is performed at a pressure of 30 to 100 bar. Embodiment 8 is the method of any of embodiments 1 to 7, wherein the processing of the heavy hydrocarbon feed includes distilling the heavy hydrocarbon feed via vacuum distillation to produce a vacuum distillation residue and a vacuum distilled hydrocarbon stream, processing the vacuum distilled hydrocarbon stream via liquid-liquid extraction to produce a poly-aromatics stream containing primarily poly-aromatics and an intermediate stream containing paraffinic, aromatic, and naphthenic hydrocarbons, and hydroprocessing the intermediate stream to produce the steam cracking feedstock. Embodiment 9 is the method of embodiment 8, further including recycling the poly-aromatics stream and/or the vacuum distillation residue to the pyrolysis unit. Embodiment 10 is the method of either of embodiments 8 or 9, wherein the vacuum distillation is performed at a feed temperature in a range of 50 to 400° C. Embodiment 11 is the method of any of embodiments 8 to 10, wherein the vacuum distillation is performed at an operating pressure of 1 to 900 mbar (abs). Embodiment 12 is the method of any of embodiments 8 to 11, wherein the liquid-liquid extraction is performed using a solvent selected from the group consisting of sulfolane or cyclic sulfones, formyl morpholine, acetyl morpholine and other morpholines, alkyl methyl pyrrolidones, dimethyl sulfoxide, and combinations thereof. Embodiment 13 is the method of any of embodiments 8 to 12, wherein the liquid-liquid extraction is performed in one or more extraction columns, one or more extraction drums, one or more contact vessels, or combinations thereof. Embodiment 14 is the method of any of embodiments 8 to 13, wherein the hydroprocessing of the intermediate stream is performed at a temperature in a range of 200 to 450° C. Embodiment 15 is the method of any of embodiments 8 to 14, wherein the hydroprocessing of the intermediate stream is performed at a pressure of 30 to 200 barg. Embodiment 16 is the method of any of embodiments 1 to 15, further including, prior to the separating step, dewatering the blended feed to produce a dewatered blended hydrocarbon feed. Embodiment 17 is the method of embodiment 16, wherein the dewatering is performed in a dewatering unit selected from the group consisting of a coalesce, a decanter, a resin based water absorption unit, a pervaporation unit, a membrane based dewatering unit, and combinations thereof. Embodiment 18 is the method of any of embodiments 1 to 17, wherein the cracking step further produces aromatics selected from the group consisting of benzene, toluene, xylene, and combinations thereof.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method of producing one or more olefins, the method comprising:

pyrolyzing a plastic material in a pyrolysis unit to form a plastic derived oil;

blending the plastic derived oil with a used lubricating oil to form a blended hydrocarbon feed;

separating the blended hydrocarbon feed to form (1) a light-end stream comprising primarily $C_1$ to $C_8$ hydrocarbons and (2) a heavy hydrocarbon feed;

hydroprocessing the light-end stream to produce a hydroprocessed light-end stream;

flowing the hydroprocessed light-end stream to a steam cracking unit;

processing the heavy hydrocarbon feed to produce a steam cracking feedstock; and cracking (1) hydrocarbons of the steam cracking feedstock and (2) hydrocarbons of the light-end stream to produce one or more olefins;

wherein the processing of the heavy hydrocarbon feed comprises:

distilling the heavy hydrocarbon feed via vacuum distillation to produce a vacuum distillation residue and a vacuum distilled hydrocarbon stream;

processing the vacuum distilled hydrocarbon stream via liquid-liquid extraction to produce a poly-aromatics stream comprising primarily poly-aromatics and an intermediate stream comprising paraffinic, aromatic, and naphthenic hydrocarbons;

hydroprocessing the intermediate stream to produce the steam cracking feedstock; and recycling the poly-aromatics stream and/or the vacuum distillation residue to the pyrolysis unit;

wherein a used lubricating oil is lubricating oil that has partially or completely lost its capability of reducing the friction, heat, and wear between mechanical components after a period of usage or that has accumulated contaminants after a period of usage;

wherein the hydroprocessing of the intermediate stream is performed at a pressure of 70 to 200 barg and at an increased pressure and/or increased temperature compared to the hydroprocessing of the light-end stream; and wherein the pyrolizing is carried out at a temperature in a range of 100 to 500° C.

2. The method of claim 1, wherein the hydroprocessing of the light-end stream is performed at a temperature in a range of 250 to 400° C.

3. The method of claim 1, wherein the hydroprocessing of the light-end stream is performed at a pressure of 30 to 100 bar.

4. The method of claim 1, wherein the poly-aromatics stream is recycled to the pyrolysis unit for the recycling step.

5. The method of claim 1, wherein the polyaromatics stream and the vacuum distillation residue are recycled for the recycling step.

6. The method of claim 1, wherein the vacuum distillation is performed at an operating pressure of 1 to 900 mbar (abs).

7. The method of claim 1, wherein the liquid-liquid extraction is performed using a solvent selected from the group consisting of sulfolane or cyclic sulfones, formyl morpholine, acetyl morpholine and other morpholines, alkyl methyl pyrrolidones, dimethyl sulfoxide, and combinations thereof.

8. The method of claim 1, wherein the liquid-liquid extraction is performed in one or more extraction columns, one or more extraction drums, one or more contact vessels, or combinations thereof.

9. The method of claim 1, wherein the hydroprocessing of the intermediate stream is performed at a temperature in a range of 200 to 450° C.

10. The method of claim 1, further comprising, prior to the separating step, dewatering the blended feed to produce a dewatered blended hydrocarbon feed.

11. The method of claim 10, wherein the dewatering is performed in a de-watering unit selected from the group consisting of a coalesce, a decanter, a resin based water absorption unit, a pervaporation unit, a membrane based dewatering unit, and combinations thereof.

12. The method of claim 1, wherein the cracking step further produces aromatics selected from the group consisting of benzene, toluene, xylene, and combinations thereof.

13. The method of claim 2, wherein the cracking step further produces aromatics selected from the group consisting of benzene, toluene, xylene, and combinations thereof.

14. The method of claim 3, wherein the cracking step further produces aromatics selected from the group consisting of benzene, toluene, xylene, and combinations thereof.

15. The method of claim 10, wherein the cracking step further produces aromatics selected from the group consisting of benzene, toluene, xylene, and combinations thereof.

* * * * *